US005480328A

United States Patent [19]

Roth et al.

[11] Patent Number: 5,480,328

[45] Date of Patent: Jan. 2, 1996

[54] FILTER PLUG CONNECTOR HAVING A SHIELD HOUSING

[75] Inventors: Michael Roth; Karl Schneider, both of Munich; Ernst Liebich, Geltendorf; Josef Dirmeyer, Bodenwöhr; Egbert Wagner, Barbing, all of Germany; Peter Moerkerke, Oostende, Belgium

[73] Assignee: Siemens Aktiengesellschaft, Munich, Germany

[21] Appl. No.: 365,690

[22] Filed: Dec. 29, 1994

[63] U.S. Application is a continuation of International Application Ser. No. PCT/DE93/00495, Jun. 8, 1993.

[30] Foreign Application Priority Data

Jun. 29, 1992 [DE] Germany ..... 9208703 U

[51] Int. Cl.[6] ..... H01R 13/648

[52] U.S. Cl. ..... 439/607; 439/620

[58] Field of Search ..... 439/607, 609, 439/620

[56] References Cited

U.S. PATENT DOCUMENTS

| | | | |
|---|---|---|---|
| 4,718,866 | 1/1988 | Yamaguchi | 439/607 |
| 5,030,140 | 7/1991 | Sugiyama | 439/607 |
| 5,125,853 | 6/1992 | Hashiguchi | 439/607 |
| 5,178,562 | 1/1993 | Ermini | 439/609 |
| 5,201,675 | 4/1993 | Igarashi et al. | 439/607 |
| 5,397,250 | 3/1995 | Brions | 439/607 |

FOREIGN PATENT DOCUMENTS

| | | |
|---|---|---|
| 9005597 | 10/1991 | Germany . |
| 9106136 | 5/1991 | WIPO . |

*Primary Examiner*—Gary F. Paumen

*Attorney, Agent, or Firm*—Herbert L. Lerner; Laurence A. Greenberg

[57] ABSTRACT

In order to provide a simple connection between a shield housing and a strip body, the shield housing, which has resilient side parts with spring arms being bent inwards, is pushed over lead-in and sliding inclines on the strip body and automatically latches on an insertion side or front thereof. The spring arms of each side part, which are located alongside one another, alternately form contact elements providing contact between the shield housing and a mounting panel and sliding and latching elements for connecting the shield housing to the strip body. The invention is suitable for motor vehicle filter plug connectors.

13 Claims, 6 Drawing Sheets

FILTER PLUG CONNECTOR HAVING A SHIELD HOUSING

CROSS-REFERENCE TO RELATED APPLICATION

This application is a Continuation of International Application Serial No. PCT/DE93/00495 filed Jun. 8, 1993.

BACKGROUND OF THE INVENTION

Field of the Invention

The invention relates to a filter plug connector having a strip body of insulating material forming a chamber being open to the rear for a ferrite core configuration, a number of parallel plug pins being disposed in a grid, entering the chamber from the rear and emerging through a base of the chamber to a front of the strip body, at least some of the plug pins being guided in the chamber by holes in the ferrite core configuration, a shield housing covering side walls and at least part of the rear of the strip body and of the chamber and having a cut out for the plug pins, the shield housing having resilient or sprung side parts engaging over the side walls of the strip body and having bends on its side parts being latched onto latching devices on the front of the strip body, and a capacitive filter element for a number of the plug pins, the filter element being soldered to the plug pins on one hand and to the shield housing on the other hand, on the outside of the shield housing opposite the rear of the chamber. Such a filter plug connector is disclosed in German Utility Model DE-GM 90 05 597. In the case of that plug connector, the shield housing is fastened to the strip body through sprung side parts which engage over the side walls of the strip body and latch on its front by means of bent edge sections. In that case, once the shield housing has been pushed onto the strip body, the edge sections are bent inwards and latched in a single operation. In addition, spring arms which are integrally formed run on the edge sections along the side walls of the strip body, are bent away from the strip body and produce a contact and a ground connection without any additional measures during installation of the plug connector on a mounting panel. In that way, fastening of the shield housing is achieved in the case of the known plug connector. The fastening can generally be used well with a ground connection which can be produced at the same time as the installation. However, under certain circumstances, for example if the negative tolerances in the thickness of a mounting panel are exceeded, the shield contact, which is intrinsically reliable, may be unfavorably influenced.

SUMMARY OF THE INVENTION

It is accordingly an object of the invention to provide a filter plug connector having a shield housing, which overcomes the hereinafore-mentioned disadvantages of the hereto-fore-known devices of this general type and which achieves even more cost-effective fastening of the shielded housing and increased reliability of the screen contact.

With the foregoing and other objects in view there is provided, in accordance with the invention, a filter plug connector, comprising a strip body being formed of insulating material and having a front with latching devices, a rear and side walls; a ferrite core configuration having holes formed therein; a chamber being formed by the strip body, having an open rear for receiving the ferrite core configuration and having a base; a number of parallel plug pins being disposed in a grid, entering the chamber from the rear and emerging through the base of the chamber to the front of the strip body, at least some of the plug pins being guided in the chamber by the holes in the ferrite core configuration; a shield housing covering the side walls and at least part of the rear of the strip body and of the chamber, the shield housing having a cut out formed therein for the plug pins, having resilient side parts engaging over the side walls of the strip body, having bends on the side parts latching onto the latching devices on the front of the strip body, having edges on the side parts, and having an outer surface; a capacitive filter element for receiving a number of the plug pins, the filter element being soldered to the plug pins and to the shield housing at the outer surface of the shield housing opposite the rear of the chamber; the bends on the resilient side parts of the shield housing being mutually separate and mutually parallel individual spring arms; all of the spring arms being bent inwards from the edges of the side parts; some of the spring arms on each of the side parts lying alongside one another and alternately forming contact elements for making contact between the shield housing and a mounting panel and sliding and latching elements for connecting the shield housing to the strip body; the contact elements being bent inwards and inclined relative to a plugging direction; the sliding and latching elements being bent inwards at right angles from the side parts, having latching devices, and having free ends being bent back transversely relative to the plugging direction to form a radius; the side walls of the strip body having depressions formed therein for the contact elements and having lead-in and sliding inclines for the sliding and latching elements, to expand the side parts during connection of the shield housing and the strip body; and the latching devices of the sliding and latching elements springing inwards on the latching devices on the front of the strip body for automatically latching the sliding and latching elements, after passing over the lead-in and sliding inclines.

In the shield housing of such a filter plug connector, the bends on the sprung side parts are constructed as spring arms which are all bent inwards, wherein sliding and latching elements for connecting the shield housing to the strip body, and contact elements for causing the shield housing to make contact with a mounting panel, are formed alternately. In addition, the strip body is constructed with lead-in and sliding inclines. When a shield housing is plugged onto a strip body or the strip body is inserted into a shield housing, the sliding and latching elements run onto the lead-in and sliding inclines, as a result of which the sprung side parts of the shield housing are automatically expanded without any aids. After passing over the side walls of the strip body, that is to say when the sliding and latching elements are pushed over an end edge of the side walls on the front of the strip body, the side parts of the shield housing, and thus the sliding and latching elements, spring inwards again, with their latching device automatically latching on the latching devices on the front of the strip body.

Therefore, in the case of the filter plug connector according to the invention, the shield housing is fixed on the strip body by self-latching and without any dedicated operation, as a result of which even more cost-effective fastening of the shield housing is achieved. The contact elements, which are bent inwards in such a way that they are inclined with respect to the insertion direction, ensure that reliable contact is made with the shield, irrespective of tolerances, even in the event of unfavorable tolerance relationships in the thickness of a mounting panel.

In the case of the filter plug connector according to the invention, all of the spring arms on the shield housing are bent inwards. This is particularly advantageous from the assembly point of view. Specifically, the filter plug connector can then be fed onto a mounting panel, for example onto a front panel of equipment, without any difficulty both in the plugging or insertion direction and in directions at right angles thereto, that is to say from the side, as viewed from the plugging or insertion direction.

In accordance with another feature of the invention, the shield housing is a bent sheet-metal part being bent to be ready for use and ready for insertion.

In accordance with a further feature of the invention, the side parts of the shield housing are disposed mutually opposite one another, and the spring arms disposed on the mutually opposite side parts are aligned with one another.

In accordance with an added feature of the invention, the contact elements have a V-shape with a rounded tip.

In accordance with an additional feature of the invention, the latching devices of the sliding and latching elements are latching holes, and the latching devices on the front of the strip body are projections.

In accordance with yet another feature of the invention, each of the latching devices on the front of the strip body is a dedicated latching device for a respective one of the sliding and latching elements.

In accordance with yet a further feature of the invention, each of the side walls of the strip body has a dedicated one of the lead-in and sliding inclines for each respective one of the sliding and latching elements.

In accordance with yet an added feature of the invention, the side walls of the strip body are constructed alternately with depressions which are matched to the form of the contact elements and with lead-in and sliding inclines, corresponding to the configuration of the spring arms on the shield housing. In consequence, the side walls of the strip body are matched to the shape of the shield housing and are thus constructed in an advantageous manner for connection to the shield housing, to form a unit.

In accordance with again another feature of the invention, the side walls of the strip body each have a given extent as seen in the plugging direction, and the side walls have the lead-in and sliding inclines over approximately two thirds of the given extent and have straight surfaces being parallel to the plugging direction over approximately one third of the given extent.

In accordance with again a further feature of the invention, in order to provide a particularly simple, cost-effective and reliable retention both of the ferrite core configuration and of the filter element, a base surface of the shield housing which covers the open chamber of the strip body is provided with a centrally disposed, rectangular cut out with mutually parallel webs and pointed bars which are disposed on two mutually opposite longitudinal sides and initially lie in a plane and are directed towards one another in a developed projection of the shield housing.

In accordance with again an added feature of the invention, the webs for retention of the ferrite core configuration are bent inwards in such a way that they are inclined with respect to the base surface, and the pointed bars are bent outwards, at right angles to the base surface, for the filter element to be plugged onto. As a result of the springing effect of the webs, it is possible to ensure that the ferrite core configuration is fastened in the chamber in the strip body without any play. The configuration of the pointed bars allows the filter element to be fastened in a manner which is convenient for assembly.

In accordance with again an additional feature of the invention, in order to assist latching of the shield housing on the strip body, the spring arms which are disposed symmetrically with respect to the center of the base surface are drawn out of the base surface of the shield housing which covers the open chamber of the strip body and are bent inwards in such a way that they are inclined with respect to the base surface. These spring arms act against the plugging or insertion direction of the strip body and thus lead to secure latching of the shield housing.

In accordance with a concomitant feature of the invention, in order to provide further cost optimization, the filter element is constructed on a printed circuit board base material. Such a printed circuit board filter is more cost effective than a planar filter with a ceramic substrate and, as a result of the capability of fastening it in an advantageous manner on the shield housing, it can be installed more easily from the rear of the strip body or on its connection side.

Other features which are considered as characteristic for the invention are set forth in the appended claims.

Although the invention is illustrated and described herein as embodied in filter plug connector having a shield housing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 5:
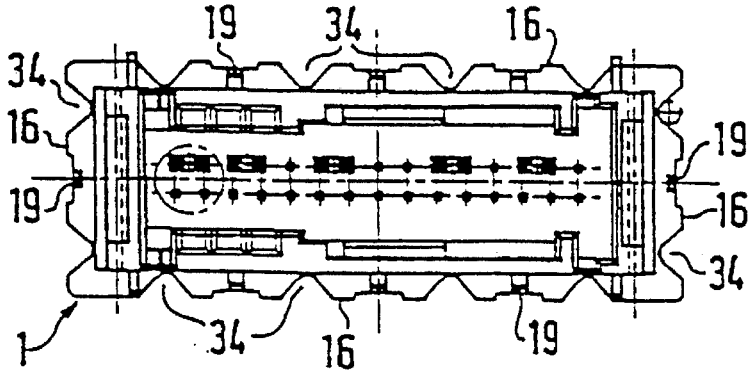
FIGS. 5 and 6 are plan views of a strip body which is part of the filter plug connector and is fitted with plug pins, namely of the insertion side shown in FIG. 5, and of the connection side shown in FIG. 6.
Figure 6:
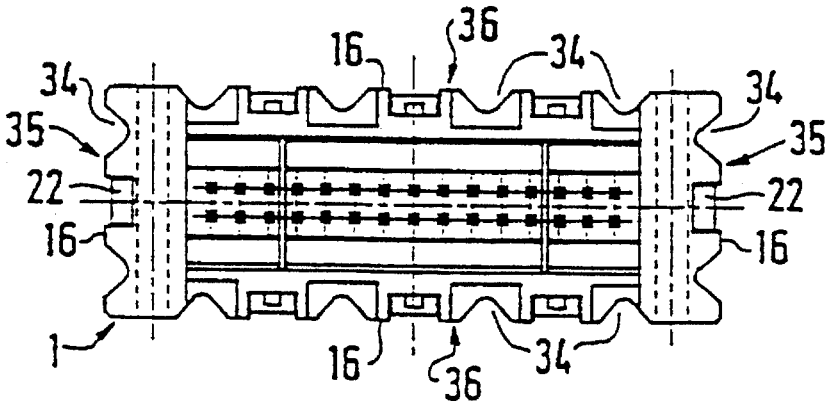
Figure 7:
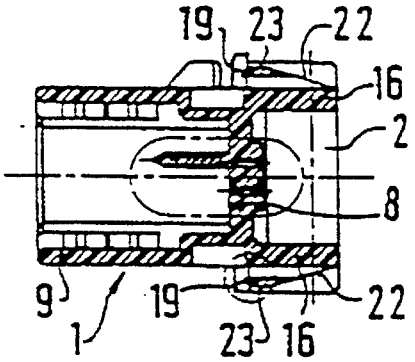
FIGS. 7 and 8 are side-elevational views of the strip body according to FIGS. 5 and 6, with FIG. 7 showing a sectional illustration.
Figure 8:
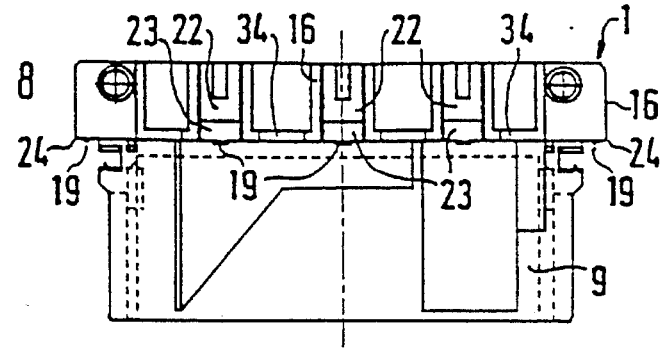

Referring now to the figures of the drawing in detail and first, particularly, to FIGS. 1 to 4 thereof, there is seen a filter plug connector which has a strip body 1 that is formed of insulating material, for example of plastic, and is illustrated in detail in FIGS. 5 to 8. The strip body 1 has side walls 16 which form a chamber 2 which is best seen in FIG. 7 and is open towards the connection side or rear, for accommodating a ferrite core configuration 3. The chamber 2 is closed by a shield housing 4, which is shown in detail in FIGS. 9 to 13. The strip body 1 furthermore has a number of parallel plug pins 5 which are disposed in a grid, which enter the chamber 2 from the connection side through holes 15 in a filter element 6 shown in FIG. 2 and through a cut out 7 in the shield housing 4 and which are passed through a base 8 of the chamber to the insertion side or front of the filter plug connector, where they form free plug ends 5*a* for connection to a plug socket. The free plug ends 5*a* are surrounded by a collar 9 which is integrally formed on the strip body 1 and has latching elements 10 on its outside for latching on a mounting panel 11, for example a front panel of a piece of equipment. On the connection side or rear, sections 5*b* of the plug pins 5 are bent approximately at right angles and are soldered to a circuit board 12 shown in FIG. 3.

The ferrite core configuration 3 which is accommodated in the chamber 2 has holes in the pattern of the grid of the plug pins. The ferrite core is plugged onto the plug pins 5 by means of the holes. For the case in which only some of the plug pins, for example two plug pins or a row or group of six plug pins, of a 30-pole filter plug connector are intended to be provided with filter elements, the ferrite core configuration may include, for example, a 2-hole ferrite core or a 6-hole ferrite core and may then be plugged only onto two plug pins or a row or group of six plug pins. The retention of the ferrite core configuration 3 without any play in the chamber 2 formed in the strip body 1 is also explained below, in conjunction with the shield housing.

Figure 1:
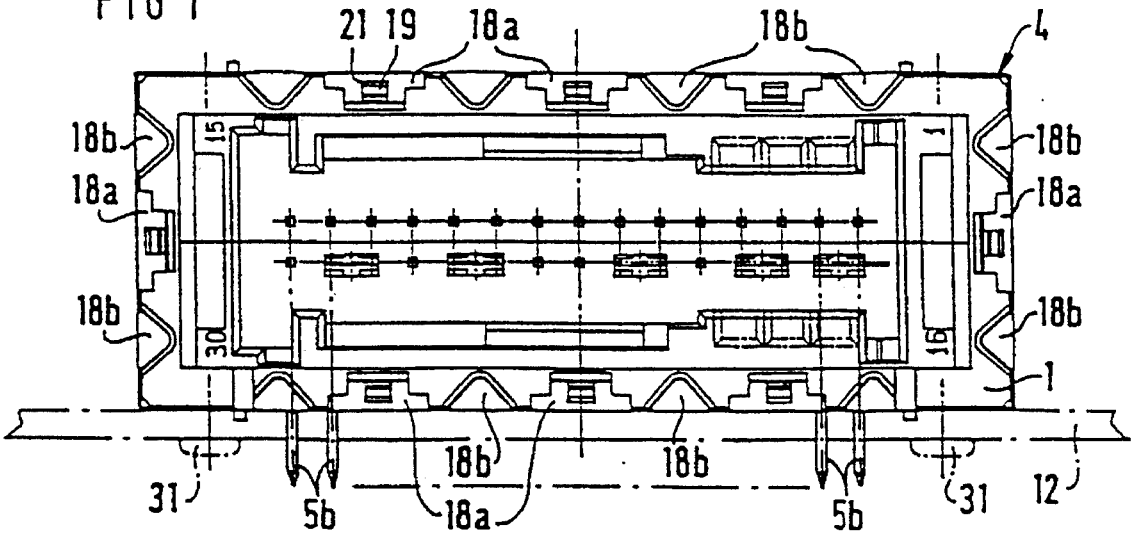
FIGS. 1 and 2 are diagrammatic plan views of a filter plug connector, namely of an insertion side or front in FIG. 1 and of a connection side or rear in FIG. 2.
Figure 2:
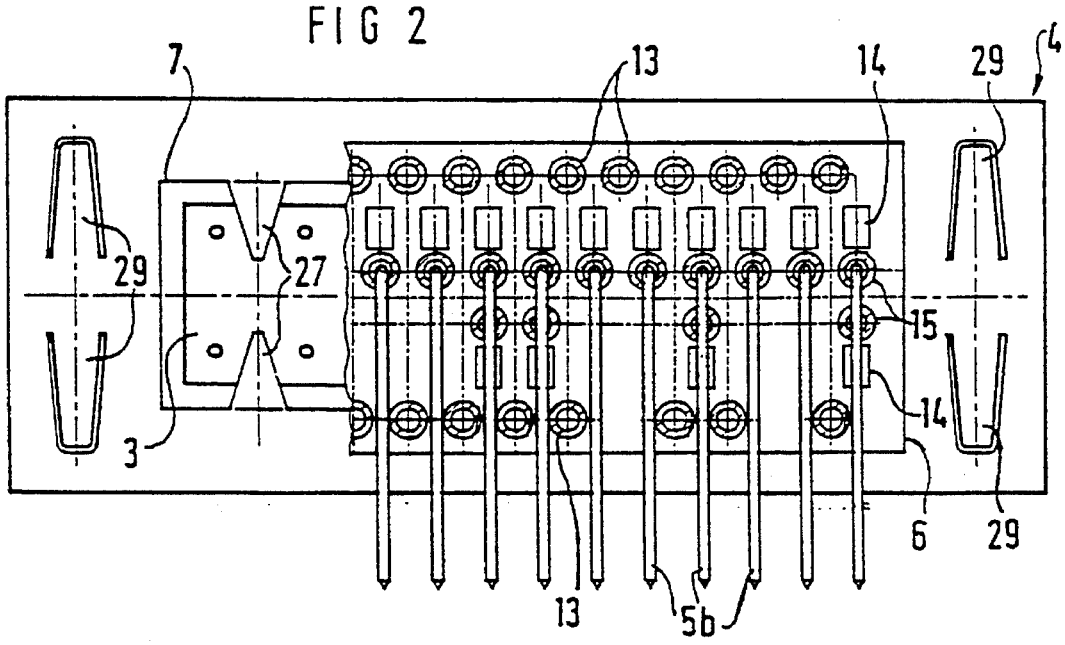
Figure 3:
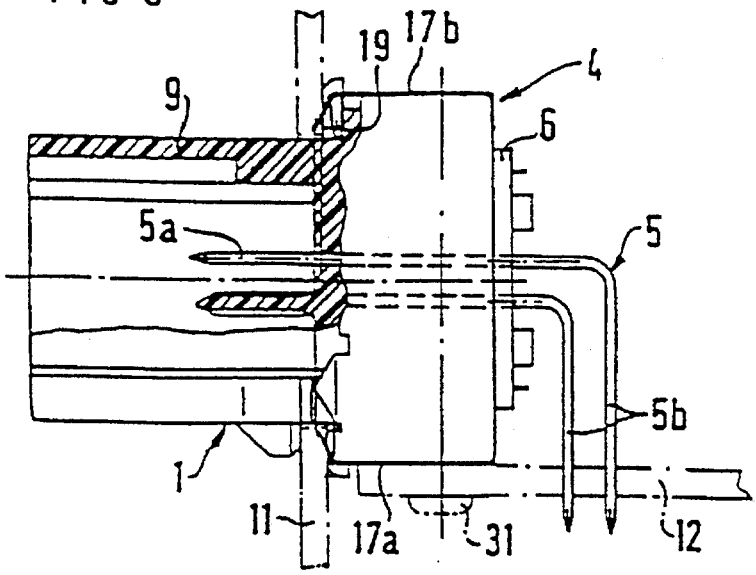
FIGS. 3 and 4 are side-elevational views of the filter plug connector.
Figure 4:
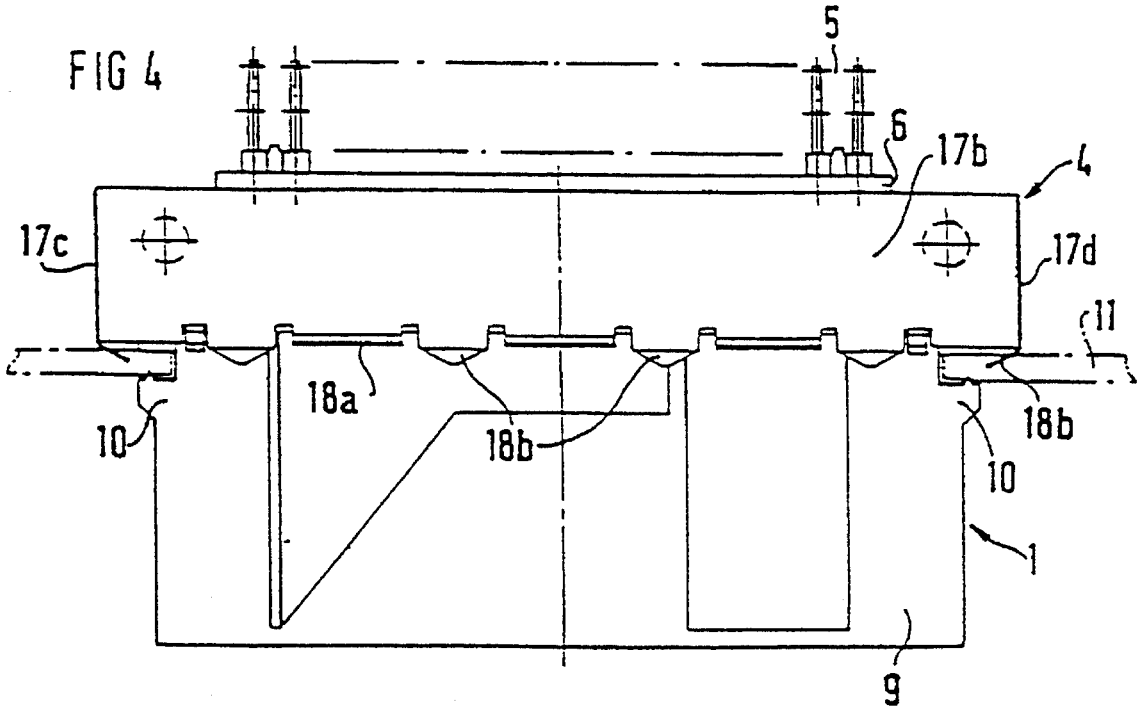

The filter element 6 shown in FIG. 2 is constructed on a printed circuit board base material, is disposed on the connection side or rear of the shield housing 4, and is provided with two mutually opposite rows having a different number of holes 13 for ground contact, with capacitors 14 between these two rows which are fitted by using the SMD technique, and with holes 15 for the plug pins 5.

Figure 9:
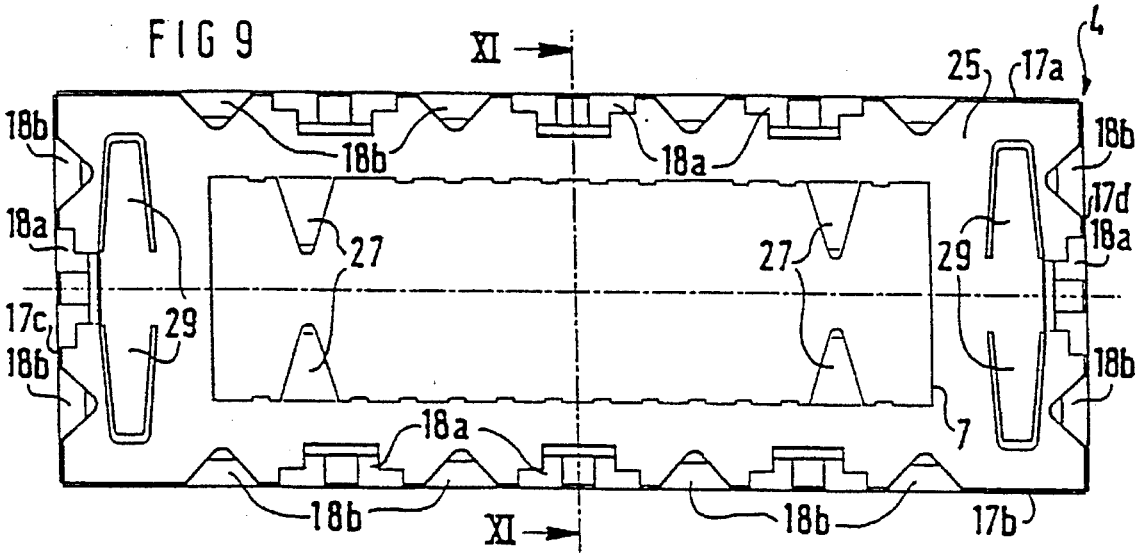
FIGS. 9 and 10 are views of a shield housing.
Figure 10:
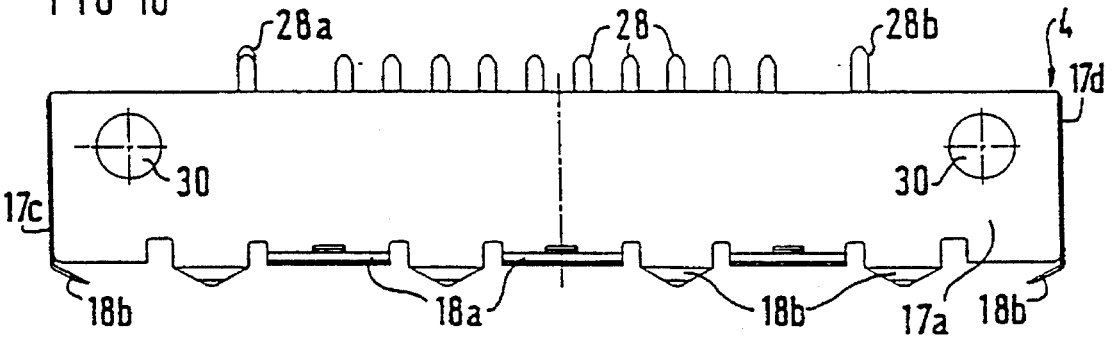
Figure 11:
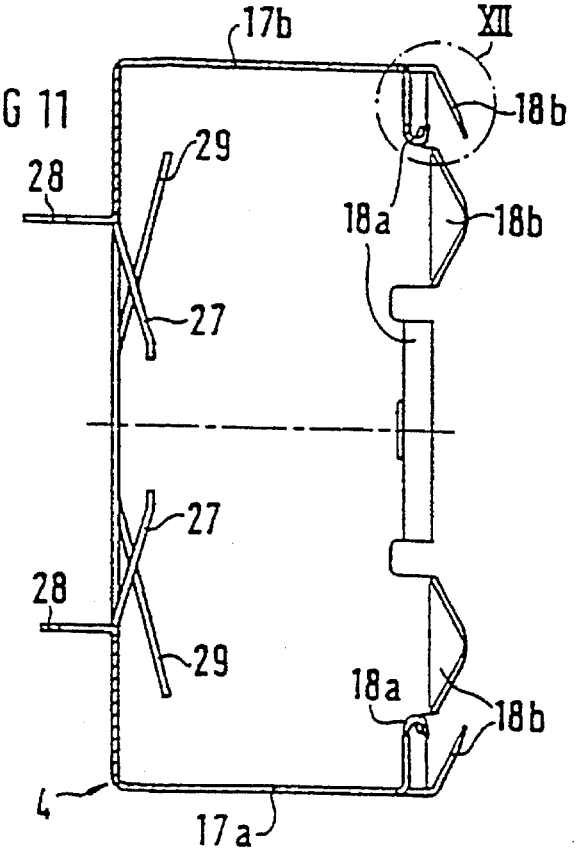
FIG. 11 is a sectional view of the shield housing which is taken along a line XI—XI of FIG. 9, in the direction of the arrows.
Figure 12:
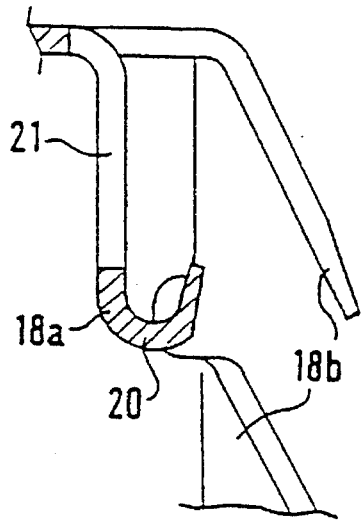
FIG. 12 is an enlarged view of a portion XII of the shield housing shown in FIG. 11.
Figure 13:
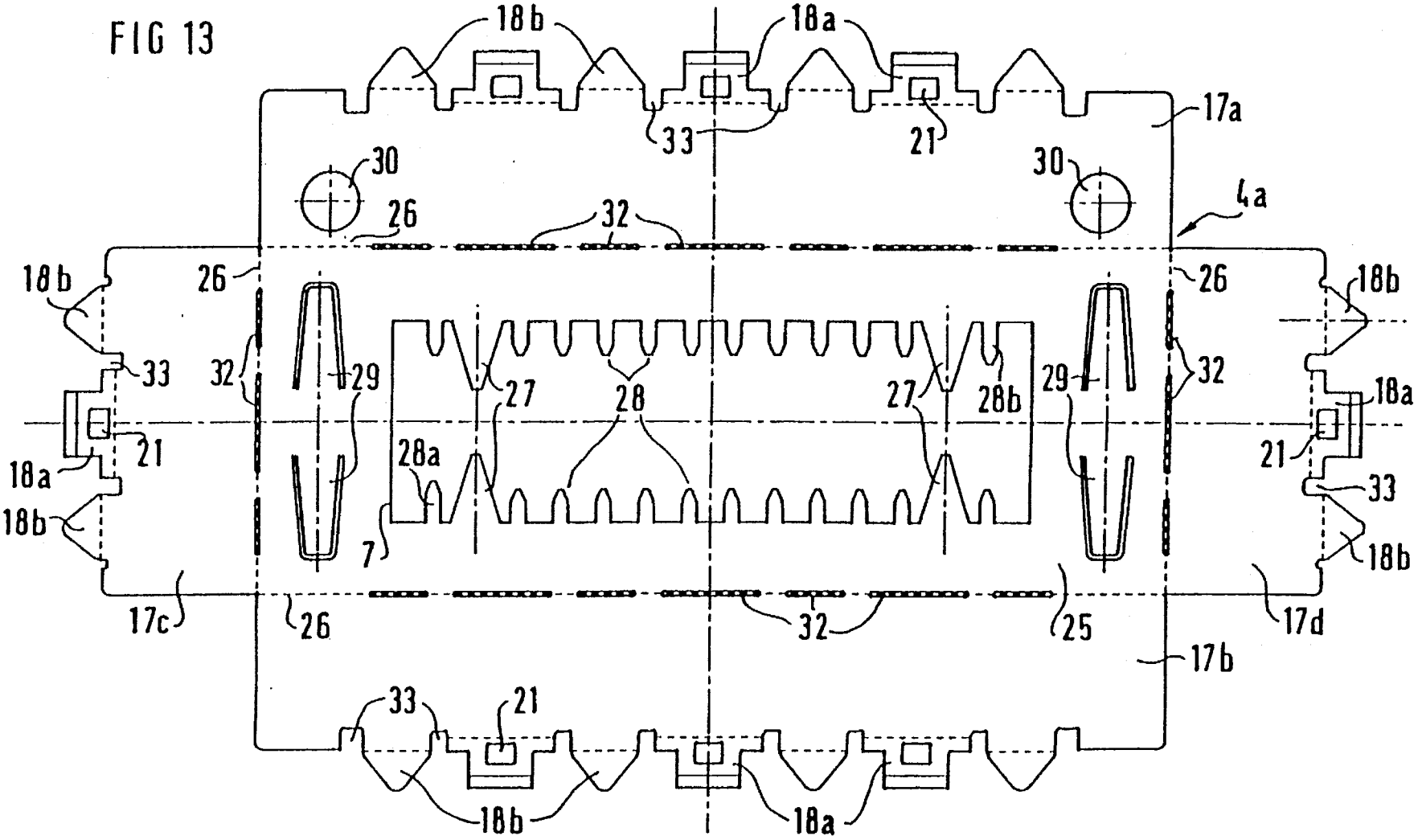
FIG. 13 is a plan view of a developed projection of the shield housing, which is formed of a bent sheet-metal part.

The shield housing shown in FIGS. 9 to 13 is a bent sheet-metal part which is bent in such a way that it is ready for use, is ready for plug insertion and covers the side walls 16 and at least part of the connection side or rear of the strip body 1 and of the chamber 2, with a cut out for the plug pins 5. The shield housing 4, which is bent out of a developed projection 4*a* of the bent sheet-metal part shown in FIG. 13 to form a rectangular trough which is not connected at its corner edges, has resilient or sprung side parts 17*a* to 17*d* which engage over the side walls 16 of the strip body 1, are constructed with bends and latch onto projections 19 on the insertion side or front of the strip body. The bends on the sprung side parts 17*a* to 17*d* of the shield housing 4 are constructed as individual spring arms 18*a*, 18*b* which are separated from one another, are parallel to one another and in each case the same number of which are disposed and aligned with respect to one another on the respective mutually opposite side parts 17*a* and 17*b*, and 17*c* and 17*d*. Thus, the side parts 17*a* and 17*b* on the longitudinal side of the shield housing 4 in each case have seven spring arms 18*a*, 18*b*, while the side parts 17*c* and 17*d* on the narrow side of the shield housing 4 in each case are constructed with three spring arms 18*a*, 18*b*. All of the spring arms are bent inwards from the edge of the side parts 17*a* to 17*d*. The spring arms of each side part which are located alongside one another alternately form contact elements 18*b* for the shield housing 4 to make contact with a mounting panel 11, and sliding and latching elements 18*a* for connection of the shield housing 4 to the strip body 1. Four contact elements 18*b* and three sliding and latching elements 18*a* in each case are provided on the side parts 17*a* and 17*b* of the shield housing 4 in the illustrated manner, while the side parts 17*c* and 17*d* on the narrow side of the shield housing 4 in each case are constructed in the illustrated manner with two contact elements 18*b* and one sliding and latching element 18*a*, which is disposed in between. The contact elements 18*b* have a V-shape as is seen in a plan view with a rounded tip as is shown in FIG. 13 and are bent inwards in such a way that they are inclined with respect to the insertion direction as is shown in FIGS. 10–12. The sliding and latching elements 18*a* are bent inwards from the side parts 17*a* to 17*d* at right angles and are provided with a latching device in the form of a latching hole 21, which starts on the bend and is used for latching the shield housing 4 on individual projections 19 on the strip body 1. In addition, at their free end, the sliding and latching elements 18*a* are bent back at an angle of somewhat less than 180°, transversely with respect to the insertion direction, forming a radius 20 shown in FIGS. 11 and 12.

The side walls 16 of the strip body 1 are tapered towards the open connection side or rear of the chamber 2, at least over a sub-region which extends in the insertion direction, in such a manner that lead-in and sliding inclines 22 for the sliding and latching elements 18*a* are formed, in order to expand the sprung side parts 17*a* to 17*d* of the shield housing. In this case, the side walls 16 of the strip body 1 in each case are provided with a dedicated lead-in and sliding incline 22 for each sliding and latching element 18*a*, which is matched to the construction of the shield housing 4. These lead-in and sliding inclines are separated from one another corresponding to the mutual separation between the sliding and latching elements 18*a*.

As is seen in the insertion direction, in this case the side walls 16 of the strip body 1 are each constructed with the lead-in and sliding inclines 22 over approximately two thirds of their extent and with straight surfaces 23, which are parallel to the insertion direction, over approximately one third of their extent. These straight surfaces extend as far as edges 24 on the insertion side or front of the strip body 1.

In addition, as FIGS. 5 and 6 show particularly clearly, the side walls 16 of the strip body 1 are also constructed with depressions 34 which are provided for the contact elements 18*b* and are matched to their shape. As is shown in FIG. 6, these depressions in this case extend on narrow sides 35 over the entire height of the side walls 16 of the strip body and only extend on longitudinal sides 36 in a short section of the side walls 16. That section is adjacent the collar 9 shown in FIG. 8.

Furthermore, the shield housing 4 is also constructed in a manner which is advantageous for passing the plug pins 5 through and for retention of the filter element 6 and of the ferrite core configuration 3. To that end, a base surface 25 of the shield housing 4 which covers the open chamber 2 in the strip body 1 is provided with a centrally disposed rectangular cut out 7 which has mutually parallel webs 27 and pointed bars 28 on two mutually opposite longitudinal sides. The webs 27 and pointed bars 28 initially lie in a plane and are directed towards one another, in the developed projection of the shield housing shown in FIG. 13. The webs 27, which are tapered in a wedge shape, are bent inwards, in such a way that they run obliquely with respect to the base surface 25, for retention of the ferrite core configuration 3, as can be seen in FIG. 9, so that they press the ferrite core configuration in a sprung manner against the base 8 of the chamber 2. In contrast, the pointed bars 28, which are somewhat shorter than the webs, are bent outwards at right angles to the base surface 25 for plugging the filter element 6 on. Mutually diagonally opposite outer pointed bars 28*a* and 28*b* are somewhat longer than the other pointed bars 28 and, once the filter element 6 has been plugged on, are bent around in order to fix the filter element 6 temporarily until the soldering process. Finally, other spring arms 29 which are disposed symmetrically with respect to the center of the base surface are drawn out of the base surface 25 of the shield housing 4 which covers the open chamber 2 in the strip body 1, and are bent inwards in such a way that they are inclined with respect to the base surface 25. It is possible to see in FIGS. 9 and 13 that these spring arms 29 run in the longitudinal direction essentially parallel to the side parts 17*c* and 17*d* of the shield housing 4. The spring arms 29 are used for automatically latching the shield housing 4 on the strip body 1.

For reasons of completeness, it is added that the side part 17*a* of the shield housing 4 has two circular holes 30 for fastening rivets 31 in order to fasten the filter plug connector on the circuit board 12, narrow longitudinal slots 32 in bending edges 26 of the side parts 17*a* to 17*d*, as well as small incisions 33 in the side parts 17*a* to 17*d* disposed laterally with respect to the spring arms 18*a*, 18*b*, as bending aids.

During assembly of the plug connector, the filter element 6 is initially temporarily mounted on the shield housing 4, that is to say it is plugged onto the upright pointed bars 28, 28*a* and 28*b*, with the longer, diagonally opposite outer pointed bars 28*a* and 28*b* being bent around and the filter element 6 consequently being temporarily fixed. The filter element is thus fed in a simple manner from the connection side or rear to the shield housing. At this point, the ferrite core configuration 3 is plugged or threaded onto the plug pins 5. Subsequently, the shield housing 4 is pushed onto the strip body 1, or the latter is plugged into the shield housing, which automatically latches on the strip body in the manner described, by means of the spring arms 29 which are disposed in the base surface 25 of the shield housing 4. A dip-soldering process is then carried out, during which the plug pins 5 are soldered in the holes 15 in the filter element 6 in one operation, and the ground connections are made between the pointed bars 28, 28*a*, 28*b* and the associated holes 13. After soldering, the plug pins 5 are bent at right angles. This assembly sequence can be carried out in a particularly cost effective manner.

We claim:

1. A filter plug connector, comprising:

a) a strip body being formed of insulating material and having a front with latching devices, a rear and side walls;

b) a ferrite core configuration having holes formed therein;

c) a chamber being formed by said strip body, having an open rear for receiving said ferrite core configuration and having a base;

d) a number of parallel plug pins being disposed in a grid, entering said chamber from the rear and emerging through said base of said chamber to the front of said strip body, at least some of said plug pins being guided in said chamber by said holes in said ferrite core configuration;

e) a shield housing covering said side walls and at least part of the rear of said strip body and of said chamber, said shield housing having a cut out formed therein for said plug pins, having resilient side parts engaging over said side walls of said strip body, having bends on said side parts latching onto said latching devices on the front of said strip body, having edges on said side parts, and having an outer surface;

f) a capacitive filter element for receiving a number of said plug pins, said filter element being soldered to said plug pins and to said shield housing at said outer surface of said shield housing opposite said rear of said chamber;

g) said bends on said resilient side parts of said shield housing being mutually separate and mutually parallel individual spring arms;

h) all of said spring arms being bent inwards from said edges of said side parts;

i) some of said spring arms on each of said side parts lying alongside one another and alternately forming contact elements for making contact between said shield housing and a mounting panel and sliding and latching elements for connecting said shield housing to said strip body;

j) said contact elements being bent inwards and inclined relative to a plugging direction;

k) said sliding and latching elements being bent inwards at right angles from said side parts, having latching devices, and having free ends being bent back transversely relative to the plugging direction to form a radius;

l) said side walls of said strip body having depressions formed therein for said contact elements and having lead-in and sliding inclines for said sliding and latching elements, to expand said side parts during connection of said shield housing and said strip body; and m) said latching devices of said sliding and latching elements springing inwards on said latching devices on the front of said strip body for automatically latching said sliding and latching elements, after passing over said lead-in and sliding inclines.

2. The filter plug connector according to claim 1, wherein said shield housing is a bent sheet-metal part being bent to be ready for use and ready for insertion.

3. The filter plug connector according to claim 1, wherein said side parts of said shield housing are disposed mutually opposite one another, and said spring arms disposed on said mutually opposite side parts are aligned with one another.

4. The filter plug connector according to claim 1, wherein said contact elements have a V-shape with a rounded tip.

5. The filter plug connector according to claim 1, wherein said latching devices of said sliding and latching elements are latching holes, and said latching devices on the front of said strip body are projections.

6. The filter plug connector according to claim 1, wherein each of said latching devices on the front of said strip body is a dedicated latching device for a respective one of said sliding and latching elements.

7. The filter plug connector according to claim 1, wherein each of said side walls of said strip body has a dedicated one of said lead-in and sliding inclines for each respective one of said sliding and latching elements.

8. The filter plug connector according to claim 7, wherein said side walls of said strip body alternately have said depressions being matched to a shape of said contact elements and said lead-in and sliding inclines, corresponding to a configuration of said spring arms of said shield housing.

9. The filter plug connector according to claim 1, wherein said side walls of said strip body each have a given extent as seen in the plugging direction, and said side walls have said lead-in and sliding inclines over approximately two thirds of said given extent and have straight surfaces being parallel to the plugging direction over approximately one third of said given extent.

10. The filter plug connector according to claim 1, wherein said shield housing has a base surface covering said open chamber formed by said strip body, said cut out formed in said shield housing is a centrally disposed, rectangular cut out in said base surface having two mutually opposite longitudinal sides and mutually parallel webs and pointed bars disposed on said two mutually opposite longitudinal sides, said webs and pointed bars initially lying in a plane and being directed towards one another in a developed projection of said shield housing.

11. The filter plug connector according to claim 10, wherein said webs are bent inwards to be inclined relative to said base surface for retention of said ferrite core configuration, and said pointed bars are bent outwards at right angles to said base surface for plugging said filter element on.

12. The filter plug connector according to claim 1, including other spring arms being disposed symmetrically relative to a center of said base surface of said shield housing covering said open chamber formed by said strip body, being drawn out of said base surface and being bent inwards to be inclined relative to said base surface.

13. The filter plug connector according to claim 1, including a printed circuit board base material on which said filter element is disposed.

* * * * *